United States Patent [19]

LaConti et al.

[11] Patent Number: 4,832,805

[45] Date of Patent: May 23, 1989

[54] MULTI-LAYER STRUCTURE FOR ELECTRODE MEMBRANE-ASSEMBLY AND ELECTROLYSIS PROCESS USING SAME

[75] Inventors: Anthony B. LaConti, Lynnfield; Thomas G. Coker, Lexington, both of Mass.

[73] Assignee: General Electric Company, New York, N.Y.

[21] Appl. No.: 442,211

[22] Filed: Nov. 16, 1982

Related U.S. Application Data

[63] Continuation-in-part of Ser. No. 336,112, Dec. 30, 1981, Pat. No. 4,749,452.

[51] Int. Cl.[4] ..... C25B 1/02; C25B 1/14

[52] U.S. Cl. ..... 204/98; 204/129; 204/283

[58] Field of Search ..... 204/98, 128, 283, 104, 204/129

[56] References Cited

U.S. PATENT DOCUMENTS

| | | | |
|---|---|---|---|
| 3,801,698 | 4/1974 | Lowrance et al. | 204/104 |
| 3,907,654 | 9/1975 | Radd et al. | 204/104 |
| 4,100,050 | 7/1978 | Cook et al. | 204/252 |
| 4,340,452 | 7/1982 | de Nora | 204/129 |
| 4,364,803 | 12/1982 | Nidola et al. | 204/30 |
| 4,381,979 | 5/1983 | de Nora et al. | 204/98 |
| 4,666,574 | 5/1987 | Oda et al. | 204/128 |

*Primary Examiner*—John F. Niebling
*Assistant Examiner*—Kathryn Gorgos
*Attorney, Agent, or Firm*—Pollock, Vande Sande & Priddy

[57] ABSTRACT

A unitary membrane-electrode assembly includes a structure with multiple layers having different overvoltages for the desired electrochemical reaction. The layer attached to the membrane has a higher overvoltage for the electrochemical reaction than the electrode layer attached to its upper surface thereby preferentially locating the electrochemical reaction zone a small but controlled distance away from the membrane surface. In an alkali metal halide or alkali metal sulfate electrolysis process the use of a unitary dual layer structure with a bonded remote electrode is particularly useful as a cathode side structure because it eliminates formation of concentrated caustic at the membrane surface. As a result, back migration of $OH^-$ ions is reduced and cathodic current efficiency is increased.

2 Claims, 2 Drawing Sheets

MULTI-LAYER STRUCTURE FOR ELECTRODE MEMBRANE-ASSEMBLY AND ELECTROLYSIS PROCESS USING SAME

This is a Continuation in Part of application Ser. No. 336,112, filed Dec. 30, 1981 now U.S. Pat. No. 4,749,452 in the names of Anthony B. LaConti and Thomas G. Coker, entitled Multi-Layer Electrode Membrane-Assembly and Electrolysis Process Using the Same, which is assigned to General Electric Company the assignee of the instant Application.

This invention relates to a unitary, membrane-electrode assembly useful in electrochemical cells. More particularly, it relates to an assembly utilizing a multi-layer structure with different catalytic activities in the layers to control location of the electrochemical reaction zone, and to electrolysis processes using such an assembly.

While the instant invention will be described principally in connection with the use of a dual layer structure as a cathode in a brine electrolysis cell, the invention is obviously not limited thereto as it may be used as an anode and is useful in electrolysis of feedstocks other than aqueous alkali metal halides (viz, NaCl, KCl, LiCl, NaBr, etc.). Thus, other aqueous alkali metal feedstocks, such as sodium or potassium sulfates, sodium hydroxide, sodium bicarbonate, etc. may also be used. In fact, the instant invention is useful in any process or cell using an ionically dissociable liquid feedstock, i.e., a liquid electrolyte, in which it is desired to locate an electrochemical reaction zone away from a permselective membrane while attaching the electrode structure at which the reaction takes place to the membrane to form a unitary structure.

As used in the instant application:

The term "sulfonate" refers to ion-exchanging sulfonic acid functional groups or metal (preferably alkali metal) salts thereof; the term "carboxylate" refers to ion-exchanging carboxylic acid functional groups or metal (preferably alkali metal) salts thereof, while "phosphonate" refers to ion-exchanging phosphonic acid functional groups or metal (preferably alkali metal) salts thereof.

The term "membrane" refers to solid film structures useful in electrochemical cells, particularly, though not limited to, cells for the electrolysis of alkali-metal halides. The structure may be homogeneous as to its functional groups, i.e., all sulfonate, all carboxylate, etc. or it may have layers containing different functional groups with the layers formed by laminating (with or without support fabrics) or by chemical surface modification.

The use of perfluorocarbon ion selective membranes in chlor-alkali electrolysis and in other electrolysis processes is well known. One particularly effective form of such cells and processes is described in U.S. Pats. Nos. 4,224,121 and 4,210,501 assigned to General Electric Company, the assignee of the present application and illustrate the use of a unitary membrane-electrode assembly in which one or both electrodes are attached to and distributed over the surface of the membrane. One of the principal advantages of such an assembly is that it brings the chemical reaction zone toward the surface of the membrane thereby eliminating or minimizing membrane-electrode gaps and the ir voltage drops associated with the liquid film and gaseous bubble formation in the gaps.

By moving the electrochemical reacton zone toward the surface of the membrane to which the electrode is attached, the caustic concentration at the membrane surface can be quite high. Concentrations of 40–45-weight % of caustic or higher are produced at the membrane surface although the bulk concentration in the cell is substantially lower. At such high local concentrations, back migration of the hydroxyl ion across the membrane and the resultant cathodic current inefficiencies, can be a problem even with membranes having excellent rejection characteristics. Furthermore, at concentrations in excess of 33% the membrane resistivity increases resulting in increased ir drop in the membrane layer in contact with the concentrated caustic.

Applicant has discovered that the caustic concentration at the membrane surface and back migration of hydroxy ions can be substantially reduced and the cathodic current efficiency increased by attaching an integral but multi-layered structure to the membrane; a structure which is so configured that the layer attached to the membrane is electrochemically less active than the electrode layer located on the surface of the less active layer. The electrochemically active electrode is thus located away from the membrane thereby moving the electro-chemical reaction zone a small but controlled distance away from the membrane without introducing excessive voltage drops due to liquid or gaseous films. The inner layer can, in fact, be electrochemically passive and it may or may not be electronically conductive. By moving the reaction zone to the outermost layer, water moving through the membrane with the cations and water diffusing through the liquid pervious outer layer from the bulk catholyte dilutes caustic formed at the second layer and reduces the caustic concentration at the membrane.

Furthermore, hydrogen transport through the bonded outer or remote layer is in a direction such that evolved gases move toward the bulk liquid preventing formation of gaseous films or bubbles at the membrane surface. The reduction in membrane resistivity due to the much lower caustic concentration at the membrane surface more than compensates for any ir drop due to any liquid in the inner layer through which the sodium ions must pass to get to the reaction zone where caustic is formed. Thus, in addition to improving the current efficiency, the cell voltage is maintained at low values so that very efficient electrolysis processes are realized.

Although cells and processes utilizing such unitary membrane-electrode assemblies are characterized by low cell voltages and good current efficiencies and are able to function with very low loadings (mg/cm) of the expensive catalytic materials, the thinness of the electrode, against which a current collector is pressed, may not cushion the pressure adequately so that distortion of or damage to the membrane may occur. Attaching a dual or multi-layer structure to the membrane has a cushioning effect for current collector pressure and protects the membrane against deformation or damage. It is thus possible to lower the quantity of catalytic material used in the low over-voltage layer since a greater latitude in contact pressure is possible without risking damage to the membrane.

The outer or remote layer at which the electrochemical reaction takes place can be a bonded agglomerate of the low overvoltage electro-catalyst plus a polymeric binder such as polytetrafluoroethylene. However, the invention is by no means limited thereto as this layer may be an admix of the low overvoltage material plus an electronically conducting metallic diluent which has a higher overvoltage for the reaction so that the conductivity of the layer is increased and the loading of the precious metal catalyst in the bonded remote electrode layer is reduced.

It is, therefore, a principal objective of this invention to provide an improved electrolysis process in which the electro-chemical reaction zone is spaced from a permselective membrane.

A further objective of this invention is to provide an improved chlor-alkali electrolysis process with dual reaction zones at an electrode forming part of a multi-element structure attached to an ion-transporting membrane.

Another objective of the invention is to provide a unitary assembly of a membrane with a multi-layered current collector-electrode structure attached to the membrane.

Further objectives and advantages of the invention will become apparent as the description thereof proceeds.

In accordance with the invention the unitary membrane-electrode assembly has a liquid and gas permeable dual layer structure attached to the membrane surface. The inner layer attached to the membrane has a higher overvoltage for the electrochemical reaction - evolution of hydrogen and production of caustic at the cathode in a chlor-alkali or alkali metal sulfate electrolysis system - than the outer layer so that the reaction takes place principally at the outer layer. The inner layer which supports the electrochemically active electrode is preferably electronically conductive. As a result, the inner layer functions as a current distributor contacting the underside of the electrochemically active outer layer; as a cushion against pressure from screen current collect; as a bubble barrier; and as an electrolyte spacer.

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings in which:

Figure 1:
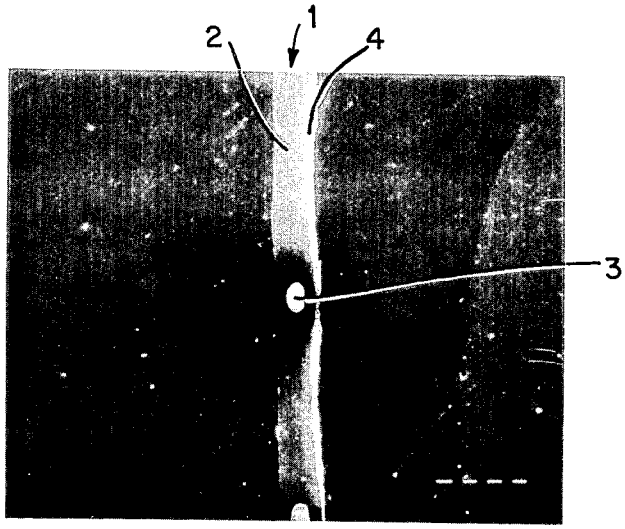
FIG. 1 is a scanning electron microscope view at 30 magnifications of a cloth supported laminate membrane having a dual current collector-electrode structure bonded to one side.

FIG. 1 shows an electron microscope section of a cloth supported laminate membrane 1 having a main or sulfonate ion-exchanging layer 2 laminated to a high rejection carboxylic layer by means of a support fabric 3. Attached to the surface of the caboxylic layer and shown on the right-hand side is a dual layer structure 4 which consists of a porous liquid and gas permeable current conducting, nickel layer bonded directly to the high rejection cathode side membrane layer 4. A thin electrochemically active electrode is deposited on and attached to the surface of the non-gas evolving nickel.

Figure 2:
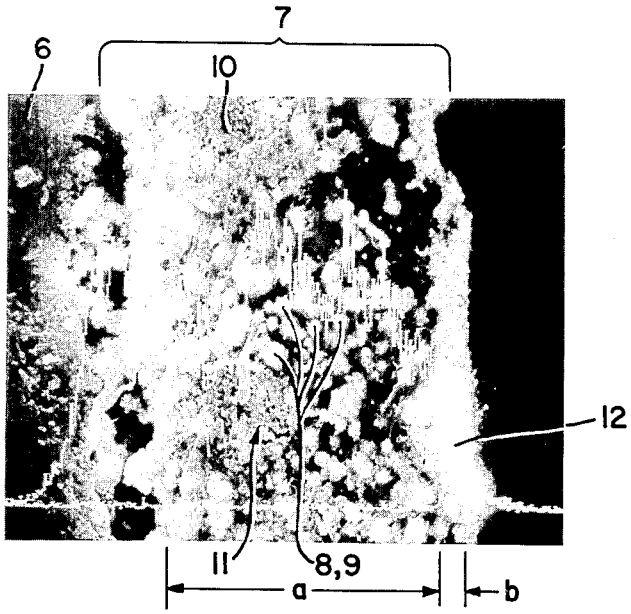
FIG. 2 is a scanning electron microscope view at 2000 magnifications of the current collector-electrode structure attached to one side of the membrane.

FIG. 2 shows a portion of the dual layer structure of FIG. 1 attached to the high rejection layer of the membrane at 2000 magnifications. A porous bonded aggregate of electronically conductive particles 7 is attached to the cathode side membrane layer 6. Layer 7 is attached to the membrane preferably by the application of heat and pressure. Conductive layer 7 includes conductive metallic particles such as nickel or partially oxidized nickel particles 8 and 9 bonded together by a polymeric binder shown at 10 and 11. The polymeric binder is preferably a fluorocarbon such as polytetrafluoroethylene of the type sold by the DuPont Company under its designations T-15 or T-30. Positioned on the surface of layer 7 is an electrode layer 12 consisting principally of electro-catalytic particles which have a lower overvoltage for the reaction than the particle in inner layer 7. These catalytic particles which may be platinum metal group particles or oxides thereof are bonded to the surface of the nickel or partially oxided nickel layer. The platinum group metals have a very low overvoltage for the electrochemical reaction so that the reaction takes place at electrode 12. Preferably 80 weight % of the electro catalytic particles pass through a 400 mesh thereby providing a range of particle sizes from 1 to approximately 10 microns average diameter. The electronically conductive layer 7 is approximately 3.0 $(2.77)\times10^{-3}$ cm thick while the thickness b of electrode layer 12 is about 0.3 $(0.27)\times10^{-3}$ cm.

Electrode 12 may consist solely of the electrochemically active particles, or it may be a bonded agglomerate of catalytic particles and of particles of a polymeric binder such as polytetrafluorethylene. The electrochemically active electrode layer, may also contain particles of a high overvoltage conductive diluent in order to increase the lateral conductivity of the layer while at the same time reducing the content of the expensive catalyst.

Figure 3:
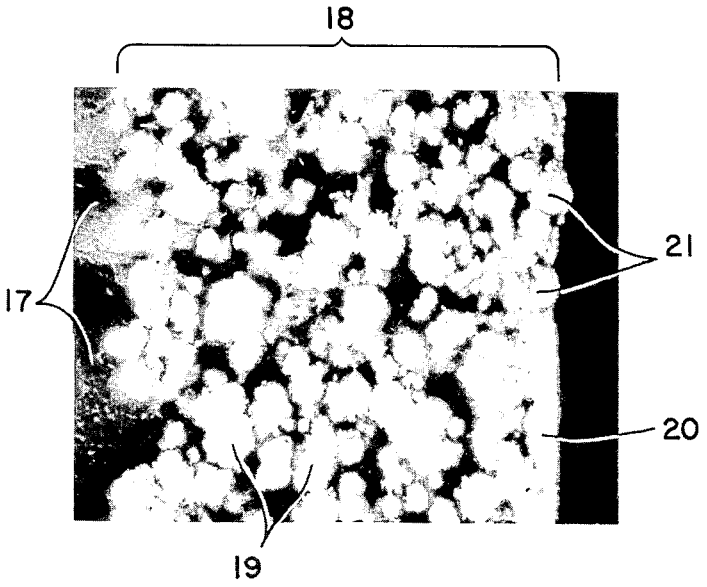
FIG. 3 is a scanning electron microscope view at 2000 magnifications of a multi-layer structure bonded to a membrane wherein the bonded, remote electrode layer is an admix of electrochemically active material and a conductive diluent.

FIG. 3 shows a dual layer structure in which the inner layer consists solely of the higher overvoltage material, viz nickel, nickel oxide, partially oxided nickel, $(RuTi)O_x$, $(RuSn)O_x$, $TiO_x$, $SbO_x$, $RuO_x$, etc., while the outer layer is an admix of the higher and lower overvoltage materials with the former, i.e., the conductive, higher overvoltage material, acts as a conductive diluent. The electrochemical reaction zone is still maintained at a controlled distance from the membrane, but the loading of the costly catalyst can be reduced.

A conductive essentially non-gas evolving layer 18 of nickel particles is bonded to the surface of membrane 17. Layer 18 is a bonded aggregate of the conductive, nickel particles and a polymer such as polytetrafluorethylene. A surface electrode layer consists of an admix of electrochemically reactive platinum group metal 20 and conductive but high overvoltage diluent particles 21 which may be nickel or other conductive particles.

The inner layer is approximately $3.0\times10^{-3}$ cm thick with a loading of 10 mg of nickel per $cm^2$. The admix of platinum black and nickel in the electrode layer has a loading of 1 $mg/cm^2$ of each of the platinum and nickel components. The thickness of the electrode layer is approximately $0.3\times10^{-3}$ cm.

The novel process and the novel unitary membrane-electrode assembly are useful in brine or sodium sulfate electrolysis in which the cell is divided into anode and cathode chambers by the unitary membrane-electrode assembly. The dual layer structure is attached to the side of the membrane facing the cathode chamber to locate the electrochemical reaction zone—i.e., the zone in which hydrogen ions are discharged to form hydrogen gas and sodium ions reacted to form caustic—away from the membrane by a distance equal at least to the thickness of the inner layer. The anode may, if desired, be a similar dual layer structure. Alternatively, a single layer anode electrode of the type shown in the aforesaid patents, may be attached to the other surface of the membrane. The anode electrode need not necessarily be attached to the membrane as a Dimensionally Stable Anode (DSA) comprising a titanium or other valve metal substrate covered with a catalytic layer of a platinum group metal or a platinum group metal oxide may be positioned against or adjacent to the membrane facing the anode chamber.

Current collectors in the form of nickel or stainless steel screens are positioned against the cathode layer of the dual structure and platinized niobium screens are positioned against the anode, whether single or dual layer. The current collectors are, in turn, connected to a power source to supply current to the cell. The cell also includes stainless steel cathode and titanium anode endplates and the membrane-electrode assembly is positioned between the endplates using Teflon or other chemically resistant gaskets.

The perfluorocarbon membrane typically is a copolymer of polytetrafluoroethylene (PTFE) and a fluorinated vinyl compound such as polysulfonyl fluoride ethoxy vinyl ether. Pendant side chains containing sulfonate, carboxylate, phosphonate or other ion-exchanging functional groups are attached to the fluorocarbon backbone. The membranes are typically from 2–15 mils thick depending whether support fabrics are incorporated in the membrane.

In a chlor-alkali system an aqueous solution of an alkali metal halide, such as brine, containing from 100 to 320 grams per liter, is introduced into the anode chamber, and chlorine and spent brine are removed from the chamber through suitable inlet and outlet conduits. Water or a dilute caustic solution is introduced into the cathode chamber and hydrogen and a concentrated 10–45 weight % solution of caustic, with 25–35 being preferred, are removed from the chamber through suitable inlet and outlet conduits.

In the case of the electrolysis of sulfates, an aqueous solution of the alkali metal sulfate containing from 200 to 400 gms/liter is introduced into the anode chamber and sulfuric acid and spent sulfate are removed through suitable inlet and outlet conduits. Water or a dilute caustic solution is introduced into the cathode chamber and hydrogen and a concentrated 10–20 weight % solution of caustic is removed from the chamber through suitable outlet conduits.

The inner layer is preferably electronically conductive so that it not only moves the electrochemical reaction zone away from the membrane but it also acts as a current distributor-collector. Hence, there is current flow from the screen current collector through the catalytic particles in the outer layer into the conductive inner layer and then laterally through the condutive inner layer to other particles in the outer layer. The inner, non-gas evolving layer may, if desired, be partially conductive or non-conductive. However, the conductivity of the outer catalytic layer and of the adjacent current collector must be correspondingly increased as the conductivity of the inner layer decreases.

By moving the reaction zone away from the membrane surface the amount of water at the membrane surface is increased and is constituted of the water pumped across the membrane with the sodium ions as well as water that diffuses through the electrode at which the action takes place to the inner layer. This increases the amount of water present there and dilutes any caustic present at the surface of the membrane. The important fact is that the caustic concentration right at the interface of the membrane is substantially lower than concentrations known to be present when the caustic producing electrode is bonded directly to the membrane and the reaction essentially takes place at the membrane surface.

Both layers may be bonded aggregates of the particles and particles of a polymeric binder such as polytetrafluoroethylene (PTFE).

If the inner layer is of a particulate nature, the particles may be of a metallic and electronically conductive material such as nickels Co; or of an electronically conductive and non-metallic material; such as carbon or graphite. Alternatively, caustic stable non-conductive oxides, such as titanium oxide, nickel oxide, tin oxide, sulfides or semiconductors may also be utilized. It must be understood that the invention is not limited to the use of a porous particulate layers. Porous, electronically-conductive metallic and non-metallic layers, such as porous nickel sheets and porous graphite paper may also be used.

Unitary bonded electrode membranes containing multiple layer structures have also been prepared where the layer against the membrane has a high lateral resistance. A dual electrode structure was prepared having a particulate Ru-doped tin oxide (Ru-15, Sn-85)$O_x$ (30% Teflon binder) inner layer and a particulate Pt-doped ruthenium black (Ru-87.5, Pt-12.5 and 30% Teflon binder) outer layer. The lateral resistance of the structure was 85 ohm/cm$^2$. The typical lateral resistance of the inner (Ru-15,Sn-85)$O_x$ layer was greater than 2 megaohms/cm$^2$. This can be compared to similarly prepared dual electrode structures having a particulate inner layer N (containing surface oxide film due to air oxidation and 30% Teflon binder) and the same Pt-doped outer layer as described above. The lateral resistance of this unitary electrode structure was approximately 5 ohm/cm$^2$. The typical lateral resistance of the inner nickel layer was 40 to 200 ohms. A cell was constructed that contained the Ru-doped tin oxide particulate inner layer and Pt-doped ruthenium black particulate outer layer. Cell voltage after approximately 100 hours operation was approximately 3.2 to 3.3 V. Cathodic efficiency was 88% (33% NaOH) and was increasing with time. The expected cathodic efficiency after 500 hours is 93 to 95% based on experience with other dual layer bonded electrode membranes.

It is evident that other doped and non-doped oxides, carbides, borides or inert non-ionic organic particulates or powders (polysulfone, PFA, FEP Teflon, etc.) could be used as the inner layer. Generally, as the electronic conductivity of the inner layer (or layers) is decreased the composition of the outer layer or layers is adjusted to insure the lateral resistance of the unitary structure remains at a reasonable value 100 ohm/cm$^2$. Preferred values are 50 ohm/cm$^2$. This is most effectively achieved by increasing the quantity of conductive diluent in the active electrode layer.

It is quite obvious that a unitary electrode/ membrane with multi-layer structure containing an electrode layer could also be used on the anode side where a halogen is evolved by electrolysis of brine, HCl, HBr, etc., or in processes involving oxygen evolution (sodium sulfate, sodium hydroxide, sodium carbonate, sodium silicate, potassium hydroxide, etc. Examples of particulate materials that would be used in the inner layer(s) against the membrane include Ta, NbTi, $TiO_2$, $SnO_2$, Ru doped $SnO_2$ or $TiO_2$. Materials for the catalytic outer layer(s) include $RuO_x$ $(Ru\text{-}Ir\text{-}Ta)O_x$, etc.

The thickness of the porous, layers is not critical and may vary. Thus it has been found that there is exellent electrode performance with the thickness of the catalytic outer layer ranging from $0.1\text{-}3.0\times10^{-2}$ cms while the inner layer may be from $0.3\text{-}30.0\times10^{-2}$ cms as measured by scanning electron microscope (SEM) at a hundred (100X) magnifications.

Also, the structure of the layers is such that the hydrogen gas transport characteristics of the outer layer cause hydrogen bubbles formed in the outer layer to flow toward the bulk electrolyte rather than into the inner layer where it may form a stagnant gas film. Higher hydrogen gas transport rates may be effected by controlling those structural characteristics of the electrode layer; viz, porosity, void volume, permeability, average pore diameter, etc. which will insure that there is a preferential direction of movement of hydrogen gas through the electrode towards the bulk electrolyte rather than toward the inner layer.

Each bonded aggregate layer is prepared by first mixing the particles with particles of a polytetrafluoroethylene binder with the weight percentage of the binder ranging from 5–45 weight percent. Suitable forms of the binder are those sold by E. I. DuPont deNemours Co., under its trade designations Teflon T-30 or T-7.

In one suitable fabricating technique, a mixture of metallic or non-metallic electronically conductive particles (for the first layer) or platinum group metal or other catalytic particles (for the outer layer) and Teflon binder particles are placed in a mold having the desired shape and dimensions of the electrode. The mixture is heated in the mold until it is sintered to form the bonded layer aggregates. The bonded structure is then placed on a thin, 2–15 mil, metallic foil which may be fabricated of Titanium, Tantalum, Niobium, Nickel, Stainless or Aluminum. The membrane is placed over the foil supported aggregate and heat and pressure is applied to attach the aggregate to one side of the membrane and the foil is then peeled off.

The mixture of particles need not be sintered to form a bonded aggregate prior to bonding to the membrane. In an alternative procedure the mixture in powder form is placed on the metallic foil and the membrane placed thereover. The application of heat and pressure bonds the particles to the membrane and to each other for form the unitary membrane-electrode assembly. The temperature, pressure and time parameters are not critical. The pressure may vary from 400–1000 psi. The temperature has an upper limit determined by the meltdown or decomposition temperature of the membrane, which for most perfluorocarbon membranes is between 400°–450° F. The lower end of the range is determined by that temperature at which adhesion becomes questionable; 250° F. seems to be the practical downside limit of the temperature range. The best temperature range is generally between 300° and 400° F. and preferably between 350° and 400°. The preferred operational conditions for bonding to the membrane are at 350° F. and 1000 psi for a period of two (2) minutes.

The duration of the heat and pressure cycle varies from 1–5 minutes and is most effective in the 2–3 minute range.

The foil is peeled off in the case of metals such as titanium, tantalum, nickel, aluminum, etc. as these are readily removed from the layer. In the case of an aluminum foil, which is relatively soft, so that the particles are sometimes partially embedded in the foil, the foil may be removed by dissolving the aluminum with sodium hydroxide and thereafter washing the bonded electrode layer with distilled water to remove any residual aluminum and sodium hydroxide. However, the removal by an aqueous solution of sodium hydroxide is not preferred since dissolution of the aluminum in sodium hydroxide may result in the impregnation or exchange of aluminum into the membrane.

After the first layer has been attached to the surface of the membrane, the outer electrochemically active layer is attached to the inner layer preferably by heat and pressure to form the dual layer electrode structure. The second layer is prepared in the manner described previously; that is, by first forming a molded aggregate, placing the molded aggregate on a metallic foil, placing the membrane and inner layer structure over the aggregate on the foil and applying heat and pressure thereby attaching the outer layer to the exposed surface of the layer previously attached to the membrane.

The procedure is the same if the particles making up the outer layer of catalyst and binder are not preformed into a bonded aggregate. Thus, the mixture of particles is placed on a metallic foil. The surface of the inner high voltage layer attached to the membrane is placed over the powder mixture on the foil and heat and pressure is applied bonding the catalytic and binder particles to each other and to the outer surface of the inner layer to form a unitary membrane-dual layer electrode assembly.

Other procedures for attaching the second layer may also be utilized. For example, the dual layer structure may be preformed and the preformed structure attached to the membrane. It is also possible to form the dual layer structure in such a manner that the outer catalytic layer is not a bonded aggregate of catalytic and binder particles but is merely a layer of catalyst. In such case, the catalytic material may be deposited on the surface of the inner layer in a variety of ways as by electrolytic deposition, vapor deposition, sputtering, etc.

In an alternative multi-layer electrode construction, particularly one in which low loadings of the expensive catalytic material in the layer in which the electrochemical reaction is to take place is desired, a three layer structure may be utilized in which a gas and liquid permeable porous outer layer consists principally of electron conductive material which has a high hydrogen/caustic overvoltage. The outer layer is deposited over a central catalytic layer which has a low $H_2$/NaOH overvoltage, so that the outer layer acts principally as a current conductor for the catalytic central layer. Thus the electrode structure has three layers in which a high overvoltage layer, which is electronically conductive, is attached directly to the membrane, a second electronically conductive and catalytic layer with a low overvoltage for the electrochemical reaction is deposited over the inner layer and a third electronically conductive but non or low-catalytically active layer is attached to the middle layer. In such an arrangement, the outer current conductive layer is fabricated to have good transport characteristics for the bulk electrolyte in order to have good mass transport of the bulk electrolyte to the central catalytic layer located between the inner layer attached to the membrane and the outer current distributing layer.

It has also been discovered that the use of multi layer structures as cathodes has the additional benefit, particularly when used with carboxylate membranes or membranes having carboxylate cathode rejection layers, of reducing transport or permeation of hydrogen gas across the membrane to the anode. To the extent membranes are subject to permeation of hydrogen, moving the reaction zone where hydrogen is produced away from the membrane surface minimizes hydrogen transport back across the membrane.

To illustrate the effectiveness of a dual layer electrode in reducing hydrogen transport across the membrane, two cells were prepared. One cell had a dual layer structure attached to the membrane facing the cathode. The inner layer was a bonded mixture of INCO 123 nickel particles with a loading of 8 mgs/cm$^2$ and 15 weight % of DuPont T-30 PTFE. The outer cathode electrode layer was a bonded mixture of 3 mgs/cm$^2$ of platinum black with 15 weight % of T-30. A second cell was constructed with a cathode electrode which was a bonded mixture of 4 mgs/cm$^2$ of palladium black with 15 weight % of T-30 bonded directly to the membrane. Both cells were run as brine electrolysis cells. The $H_2$ in chlorine content (V/V) was measured in analytical gas chromotograph—Model AGC 111-H sold by CARLE Instruments, Inc. of Fullerton, Calif.—which has a lower resolution limit of 0.1% (V/V). Set forth below is a tabulation of the results:

| DUAL LAYER | | |
|---|---|---|
| Running Times (hrs) | Current Density (A/dm$^2$) | % $H_2$ in $Cl_2$ (V/V) |
| 67 | 30 | Not detectable |
| 112 | 30 | Not detectable |
| 323 | 30 | Not detectable |
| 611 | 30 | 0.1 |
| 685 | 30 | 0.1 |

| SINGLE LAYER | | |
|---|---|---|
| Running Times (hrs) | Current Density (A/dm$^2$) | % $H_2$ in $Cl_2$ (V/V) |
| 43 | 33 | 0.8 |
| 115 | 33 | 0.6 |
| 201 | 33 | 1.0 |
| 499 | 33 | 0.7 |
| 700 | 33 | 0.5 |
| 1065 | 30 | 0.9 |

It is readily apparent from these results that hydrogen transport is reduced to an insignificant amount; an amount which essentially is below the resolution limit of the instrument.

Use of the multi layer structure as an anode is particularly beneficial in minimizing oxygen evolution due to back migration of the hydroxyl OH ions when used with acidified brine. By locating the catalytic platinum group metals away from the membrane surface, a neturalizing reaction can take place to form water with acidified brine right at the membrane high overvoltage interface before the hydroxyl ions reach the platinum catalyst and form oxygen.

The multi layer electrode is also very useful as an anode with those feedstocks, such as sodium sulfate, where both sodium and hydrogen ions are formed. By moving the reaction zone away it avoids high hydrogen cation concentrations at the membrane surface. As a result, the sodium ions are preferentially transported to the cathode and sulfuric acid formed in the anode chamber.

To illustrate the innovative aspects of the instant invention, and to show details of the process for producing the unitary membrane-dual layer electrode assembly; as well as the performance of such an assembly in a chlor-alkali cell, the following examples are provided:

EXAMPLE 1

A membrane-electrode assembly was prepared using a 14 mil cloth supported laminate. The laminated membrane has a 2 mil thick perfluorocarbon layer with carboxylate functional groups laminated to a perfluorocarbon layer having sulfonate functional groups. A 3"×3" dual layer electrode structure was attached to the carboxylic layer in the following manner:

A mixture of 23 milligrams of Shawninigan Carbon (to provide a carbon loading of 1 mg/cm$^2$) and 35 weight % of DuPont T-7 PTFE particles was placed on a nickel foil. The carboxylic layer of the membrane was placed over the powder mixture on the foil and the layer attached to the foil by applying a pressure of 1000 psi at 350° F. for two (2) minutes and the foil peeled off.

A mixture of 69 milligrams of platinum black (to provide a 3 mg/cm$^2$ loading) and 15 weight % of DuPont T-30 PTFE particles was placed on a nickel foil. The membrane was placed over the mixture with the exposed surface of the inner carbon layer attached to the membrane contacting the mixture. Pressure of 1000 psi at 350° F. was applied for two (2) minutes. The foil was then peeled off leaving a dual layer electrode structure attached to the membrane.

The membrane electrode assembly was installed in cell #1 having a titanium anode and stainless steel cathode endplates separated by the membrane and Teflon gaskets to form anode and cathode chambers. A Dimensionally Stable Anode (DSA) was positioned against the membrane in the anode chamber and a nickel screen against the catalytic outer layer of the dual layer cathode.

A control cell, cell #2, was constructed as described above which differed only in that the cathode electrode attached to the membrane had a single layer consisting of a bonded aggregate of 1 mg/cm$^2$ of carbon with 35 weight % of DuPont T-7 PTFE; i.e. the cathode was the same as the high overvoltage inner layer of the dual layer structure.

Both cells were operated with an aqueous anolyte solution containing 250 grams of NaCl per liter* and a catholyte feed of about 28–30 weight % aqueous NaOH catholyte. The performance of both cells was measured and the results were as follows:

TABLE I

| Running Hours | Current Density (A/ft$^2$ ASF) (A/dm$^2$) | T (°C.) | Cell Volts | NaOH (Bulk) (Wt. %) | Cathodic Current Efficiency % (C.E.) |
|---|---|---|---|---|---|
| CELL #1 WITH DUAL LAYER CATHODE: | | | | | |

TABLE I-continued

| Running Hours | Current Density (A/ft² ASF) (A/dm²) | T (°C.) | Cell Volts | NaOH (Bulk) (Wt. %) | Cathodic Current Efficiency % (C.E.) |
|---|---|---|---|---|---|
| 162 | 304 ASF | 85 | 3.26 | 31.3 | 91 |
| 186 | 304 ASF | 78 | 3.23 | 30.3 | 88 |
| 258 | 304 ASF | 84 | 3.28 | 31.1 | 89 |
| 306 | 304 ASF | 81 | 3.26 | 30.6 | 91 |
| 354 | 304 ASF | 84 | 3.27 | 31.1 | 90 |
| 450 | 304 ASF | 77 | 3.35 | 32.5 | 94 |
| 522 | 304 ASF | 78 | 3.42 | 33.7 | 94 |
| 594 | 30 a/dm² (276 ASF) | 75 | 3.30 | 32.5 | 98 |
| 642 | 30 A/dm² | 73 | 3.27 | 32.0 | 95 |
| 690 | 30 A/dm² | 90 | 3.30 | 33.9 | 95 |
| CELL #2 (CONTROL) WITH SINGLE LAYER CATHODE: | | | | | |
| 46 | 304 ASF | 82 | 3.52 | 33.7 | 90 |
| 94 | 304 ASF | 82 | 3.52 | 31.3 | 89 |
| 190 | 304 ASF | 85 | 3.70 | 34.1 | 90 |

It can be seen that the cathodic current efficiency over more than a month, at current densities from 275–300 ASF, ranges as high as the upper 90 percent ranges as compared to 89–90 percent for the control cell. The cell voltages were low while the cell voltages for the single layer cathodes were substantially higher due to the effects of high caustic concentrations on the membrane resistivity, and the higher $H_2$ overvoltage of the carbon.

EXAMPLE 2

A cell #3 was constructed which was identical to cell #1 in Example 1, except that the inner layer of the dual layer cathode attached to the membrane was a bonded aggregate of nickel (rather than carbon) and PTFE binder particles. The composition of the electrode being 8 mg/cm² of Inco 123 nickel with 15 weight % of DuPont T-30 PTFE. Control cell #4 similar to cell #2 of Example 1 was constructed. The cathode electrode attached to the membrane was a nickel PTFE aggregate identical to the inner layer of the dual layer electrode described above. The cells were operated with the same anolyte and catholytes and the performance of both cells measured. The results were as follows:

TABLE II

| Running Hours | Current Density (A/ft² ASF) (A/dm²) | T (°C.) | Cell Volts | NaOH (Bulk) (Wt. %) | Cathodic Current Efficiency % (C.E.) |
|---|---|---|---|---|---|
| CELL #1 WITH DUAL LAYER CATHODE: | | | | | |
| 40 | 304 ASF | 80 | 3.23 | 33.7 | 89 |
| 112 | 30 A/dm² (276 ASF) | 85 | 3.18 | 33.4 | 94 |
| 160 | 30 A/dm² | 85 | 3.17 | 33.7 | 89 |
| 184 | 30 A/dm² | 82 | 3.18 | 33.7 | 91 |
| 208 | 30 A/dm² | 84 | 3.15 | 34.1 | 92 |
| CONTROL CELL: | | | | | |
| 18 | 30 A/dm² | 81 | 3.51 | 33.0 | 89 |
| 42 | 30 A/dm² | 84 | 3.50 | 33.0 | 87 |

It can again be seen that with caustic concentrations in excess of 30 wt. %, current efficiencies in excess of 90% at low cell voltages are realized by use of the dual layer cathode attached to the membrane; efficiencies which are better than those realized with a single layer catalytic electrode. It will be appreciated that the novel dual layer electrode is effective in increasing the cathodic current efficiency by moving the electrochemical reaction zone within the electrode away from the interface of the electrode structure with the membrane.

EXAMPLE 3

A cell #5 was constructed which was identical to cell #1 in Example 1 except that the electrode layer bonded to the surface of the inner layer was an admix of a low overvoltage, chemically-reactive platinum group metal with a conductive but essentially non-reactive diluent. The dual layer structure consisted of an electro conductive inner nickel layer composed of 10 mg/cm² of nickel with 15 weight % of PTFE binder particles. The composition of the electrode layer was an admix of platinum black and nickel as a non-reactive conductive diluent. Composition of the electrode was 0.25 mg/cm² of platinum black with 1.0 mg of nickel/cm² with 15 weight % of DuPont T-30 PTFE. The cell was operated at a temperature of 90° .C and an aqueous brine solution having a concentration of 200 gms of NaCl/liter was fed into the anode chamber. The cell was operated at a current density of 30 amp/dm² with a cell voltage of 2.94 volts. After 618 hours of operation the cell had a cathodic current efficiency of 91% and produced 35.7 weight % of caustic at the cathode. This illustrates that a dual structure with an electrode which is an admix of the reactive platinum group metal in a metallic diluent performs as well as an electrode layer having only the chemical reactive metal while allowing a substantial reduction of the loading of the expensive catalytic material. That is, the loading of the platinum group metal in the cell in Example 1 was 3 mg/cm² whereas the loading in cell #4 was 0.25 gm/cm². This represents an order of magnitude of reduction in the loading of the electrochemically reactive catalyst while essentially obtaining similar results.

EXAMPLE 4

A cell including a dual cathode structure was prepared for the electrolysis of sodium sulfate. The cell included a 14 mil cloth supported DuPont Nafion 315 membrane. Nafion 315 is a cloth supported laminate with both layers containing sulfonate functional groups but with the cathode side layer having a higher equivalent weight, approximately 1500, and therefore having a higher rejection characteristic for hydroxyl ions. A 3"×3" dual layer structure was attached to the higher equivalent weight cathode side layer.

The dual structure contained an inner conductive layer bonded to the membrane. The inner layer consisted of a bonded aggregate of nickel particles with polytetrafluoroethylene. The inner structure consisted of 10 mg/cm² of Ni particles with 30 weight % of T-30 DuPont PTFE. The outer layer was a bonded aggregate of an admix of 1.75 mg/cm² of ruthenium and 0.25 mg/cm² of platinum with 30 weight % of T-30 DuPont polytetrafluoroethylene. The anode endplate was made of titanium whereas the cathode endplate was made of 316 stainless steel. A dimensionally stable anode (DSA) was positioned in the chamber. A woven nickel screen mesh was positioned against the cathode electrode layer of the dual structure.

The cell was operated at 90° C. with an aqueous anolyte solution containing 173 gms (1.17M) of sodium sulfate/liter and a distilled water catholyte feed. The performance of the cell was measured and the result was shown as follows in Table III.

TABLE III

| Running Hours | Current Density ($A/dm^2$) | Cell Voltage | $H_2SO_4$ (Wt. %) | NaOH (Wt. %) | Cathodic Current Efficiency % (C.E.) |
|---|---|---|---|---|---|
| 17 | 30 | 3.45–3.5 | 2.9 | 20.3 | 62 |
| 23 | 30 | 3.50–3.55 | 2.2 | 18.8 | 66 |
| 49 | 30 | 3.50–3.55 | 3.6 | 15.5 | 66 |
| 54 | 30 | 3.55–3.60 | 2.0 | 14.3 | 67 |

It can readily be seen from the above data that the dual layer cathode structure with the catalytic electrode positioned away from the membrane operates with great effectiveness in electrolyzing sodium sulfate as well as electrolyzing brine.

While the invention has been described in connection with certain preferred embodiments thereof, the invention is by no means limited thereto, since modifications in the structures, or the instrumentalities employed or in the steps performed in the process may be made and fall within the scope of the invention. It is contemplated by the appended claims to cover any such modifications that fall within the true spirit and scope of this invention.

What is claimed as new and desired to be secured by U.S. Letters Patent is:

1. A process for generating hydrogen and caustic which comprises electrolyzing an electrolyte solution between a pair of electrodes separated by a cation exchange membrane, the cathode side of said membrane having a liquid and gas-permeable electrode structure bonded thereto, characterized in that said bonded electrode structure is bilayer and comprises a first non-conductive layer directly bonded to said membrane and a second electrocatalytically active layer bonded to the surface of said first layer which faces away from said membrane.

2. A process according to claim 1 wherein a third layer is bonded on the surface of said electrocatalytically active layer which faces away from said membrane, said third layer being electroconductive and having a high hydrogen overvoltage whereby said third layer acts as a carrier to conduct current to said electrocatalytically active layer.

* * * * *

UNITED STATES PATENT AND TRADEMARK OFFICE

CERTIFICATE OF CORRECTION

PATENT NO. : 4,832,805

DATED : May 23, 1989

INVENTOR(S) : LaConti, et al.

It is certified that error appears in the above-identified patent and that said Letters Patent is hereby corrected as shown below:

On the cover page, change the line [73] Assignee: General Electric Company, New York, N.Y. and insert [73] Assignee: Oronzio deNora Impianti Electrochimici, S.p.A., Milan, Italy ---.

Signed and Sealed this

Twenty-fifth Day of December, 1990

*Attest:*

HARRY F. MANBECK, JR.

*Attesting Officer*

*Commissioner of Patents and Trademarks*